United States Patent [19]

Brock

[11] Patent Number: 4,512,425

[45] Date of Patent: Apr. 23, 1985

[54] UP-DRILL SUB FOR USE IN ROTARY DRILLING

[75] Inventor: Kenneth A. Brock, Sandy, Utah

[73] Assignee: Christensen, Inc., Salt Lake City, Utah

[21] Appl. No.: 468,662

[22] Filed: Feb. 22, 1983

[51] Int. Cl.[3] ..... E21B 10/46

[52] U.S. Cl. ..... 175/329; 175/408; 175/410; 175/325

[58] Field of Search ..... 175/329, 325, 408, 410, 175/401

[56] References Cited

U.S. PATENT DOCUMENTS

| | | | |
|---|---|---|---|
| 1,831,841 | 11/1931 | Brantly | 175/401 |
| 1,890,022 | 12/1932 | Santiago | 175/401 |
| 2,956,781 | 10/1960 | Eastman | 175/325 |
| 3,318,400 | 5/1967 | Hildebrandte | 175/329 |
| 4,091,884 | 5/1978 | Thomas | 175/410 |
| 4,304,311 | 12/1981 | Shinn | 175/325 |

FOREIGN PATENT DOCUMENTS

| | | | |
|---|---|---|---|
| 832025 | 5/1981 | U.S.S.R. | 175/325 |

*Primary Examiner*—Stephen J. Novosad
*Assistant Examiner*—Mark J. DelSignore
*Attorney, Agent, or Firm*—Beehler, Pavitt, Siegemund, Jagger & Martella

[57] ABSTRACT

A tool, provided in the form of an up-drill sub, is comprised of a cylindrical body having a plurality of lobes integrally formed therewith and radially extending therefrom. Each lobe in turn is provided with a plurality of diamond cutting elements on an upwardly inclined surface of the lobe. The lobes are separated by channels or junk slots. The diamond cutting elements are arranged and configured on the sloping surface of the lobe to provide a cutting or reaming action as the tool is rotated and drawn upwardly in the bore. Tungsten carbide inserts are also provided on the circumferential gage surfaces of the lobes to provide gage protection. The ends of the sub are provided with selected pin or box connections in combination as appropriate so that the up-drill sub can be used anywhere within the drill string. Therefore, the up-drill sub may be used near the bit as a near bit or elsewhere in the drill string, such as a crossover sub between the drill collar and drill pipe or above a stabilizer. The outer diameter of the lobe of the sub are set at slightly less than the diameter of the bore so that no cutting action with the bore is affected unless a restriction or other imperfection in the bore arises which would prevent easy removal of the drill string and bit from the bore.

7 Claims, 6 Drawing Figures

16
14
12
22
30
28d
28b
28c
4
4
28a
24
38
40
18
40
20

44
16
42
30
28d
28b
28c
28a
40
24
38
20
46

16
50
48
28d
30
28b
28c
28a
40
38
52
40
20

UP-DRILL SUB FOR USE IN ROTARY DRILLING

BACKGROUND OF THE INVENTION

1. Field of the Invention

The present invention relates to the field of earth boring tools and more particularly to tools used in a drill string incorporating diamond elements.

2. Description of the Prior Art

During a drilling operation, it is not uncommon for the bore being drilled to change, in time, from the diameter, shape and nature originally bored or for the bore to include bent or crooked sections. The rock formation often sluffs, swells, cakes up with hard deposits of drilling mud, slips or forms a key seat, all of which changes unavoidably either occur through the erosion or action of the drilling mud pumped down and then up through the bore, or by natural processes and events in the rock formation triggered in whole or in part by the disturbance in the formation caused by the drilling operation.

It is almost always necessary during drilling operations to trip out or remove the drilling bit which is typically attached at the lower end of a long drill string comprised of multiple 30 foot sections of pipe. In a bore not subject to any of the above changes or imperfections, the removal of the drill string and bit from the bore presents no problem, particularly in view of the fact that a perfect bore is drilled by the bit so as to have a diameter greater than the outer diameter of any other element included within the drill string. The bit thus will be the largest diameter element included within the drill string and will therefore easily slip fit out of a perfect, stable bore.

However, if in any event, any change or imperfection should arise in the bore to cause the diameter of the bore to become restricted or to introduce a sharp curvature in the bore, the bit or drill string can become wedged or jammed at the restriction or dog leg. Often, the drill string becomes so tightly jammed or seized within the bore that the drill string must be dismantled as much as possible, usually by detaching and removing that portion of the drill string above the jammed section or fish, and the fish must then be retrieved using special retrieving tools and techniques. Such a fishing operation is often extremely time-consuming and difficult, and when it occurs it can add substantial cost to the drilling operation. In fact, in some cases, retrieval of the fish is practically impossible and the hole must be redrilled around the fish which is permanently left in the bore.

Since, as described above, the bit is typically the largest diameter object in the drill string, many such jams occur when the bit becomes wedged at a constriction in the bore. In an attempt to facilitate removal of such jammed bits, the upper surface or chamfer of the bit, particularly in drag bits, have been provided with cutting elements including both natural and polycrystalline diamond elements to allow the bit to ream as it is rotated in the upward direction. Thus, when the bit is pulled up the bore, it jams against a bore restriction, the bit is rotated to ream out the constriction thereby freeing the bit to be withdrawn through the previously constricted section of the bore. However, the provision of a cutting face on the upper surface of the bit adds to the expense of manufacture and diamond material which is included within the bit, whether or not the up-drilling capacity of the bit is ever used. Thus, when a stable and problem-free bore is drilled, and the bit worn out, the unused up-drill portion of the bit is necessarily junked with the bit even though completely unused. Thus, expense is added to the cost of manufacture of the bit without any necessary increase in realized utility.

Moreover, in many cases, the drill string will jam within the bore at a dog-leg or key seat against a portion of the drill string while the bit remains essentially free. In such a case, an up-drill reaming face on the bit is totally ineffective and useless for unjamming seizure on the drill string at a distant location.

In addition, such up-drill faces on the bit have cutters with clearance of 0.105" and less, so that reaming action of such faces is minimal in many cases and is necessarily limited by the overall design of the bit. For example, such up-drill faces are not adaptable to conventional roller cone type bits.

Therefore, what is needed is a drilling tool which can ream or free a jammed bit and drill string at any location along the drill string, which can be simply used using ordinary kinds of operating procedures, which is rugged and simple of construction, which is reuseable independent of the drill bit, which may be periodically worn and replaced, and which is independent of drill bit design.

BRIEF SUMMARY OF THE INVENTION

The present invention is a tool for earth boring which is particularly to drill upwardly in the bore. The tool comprises a body and a multiple lobed circumferentially disposed collar radially extending from the body and including an upwardly inclined surface on the collar. A plurality of cutting elements are disposed on the upwardly inclined surface of the collar and are arranged and configured to cut the bore as the tool is rotated and drawn upwardly within the bore.

In particular, the body of the sub includes a connector at one end of a first predetermined type and a connector at the opposing end of a second predetermined type. The first and second predetermined types are selected according to the placement of the tool within the drill string. The gage surfaces of each of the lobes is the outermost extending portion of the tool, thereby defining the outer diameter of the tool. The outer diameter of the tool is less than the diameter of the bore by a predetermined amount, whereby drilling or reaming is not affected by the tool unless it encounters a restriction or other imperfection in the bore exceeding the predetermined amount of clearance.

The present invention is better understood by considering the following drawings wherein like elements are referenced by like numerals.

The present invention and its various embodiments may be better understood by considering the above drawings in light of the following detailed description.

DETAILED DESCRIPTION OF THE PREFERRED EMBODIMENTS

The present invention is a tool used in earth boring, particularly petroleum boring, which can be placed anywhere within the drill string, typically above or near a section of the drill string where jamming against the bore is most likely to occur. In particular, the present invention is an up-drill sub having a plurality of diamond cutters disposed on an upwardly directed, chamfered surface provided on each of a multiplicity or lobes extending circumferentially from the subsection length of pipe to provide cutting and reaming action against any constriction or sharp curvature encountered within the bore. More particularly, the present invention is a sublength of pipe configured with appropriate couplings at each end depending on the specific application, as described in greater detail below, with a plurality of circumferential extending lobes disposed at one end of the sub. Each lobe has a chamfered surface upon the upper portion of which a plurality of staggered polycrystalline diamond cutters have been set. The configuration of the cutters is such that they will cut in the upward direction as the drill string is rotated and pulled from the bore. In other words, the cutters are set in a spiral pattern in an opposite sense from that which they would assume had they been on a downwardly directed cutting surface. A corresponding plurality of gage elements is also included on each lobe to provide conventional gage protection.

Figures 1, 2, 3:
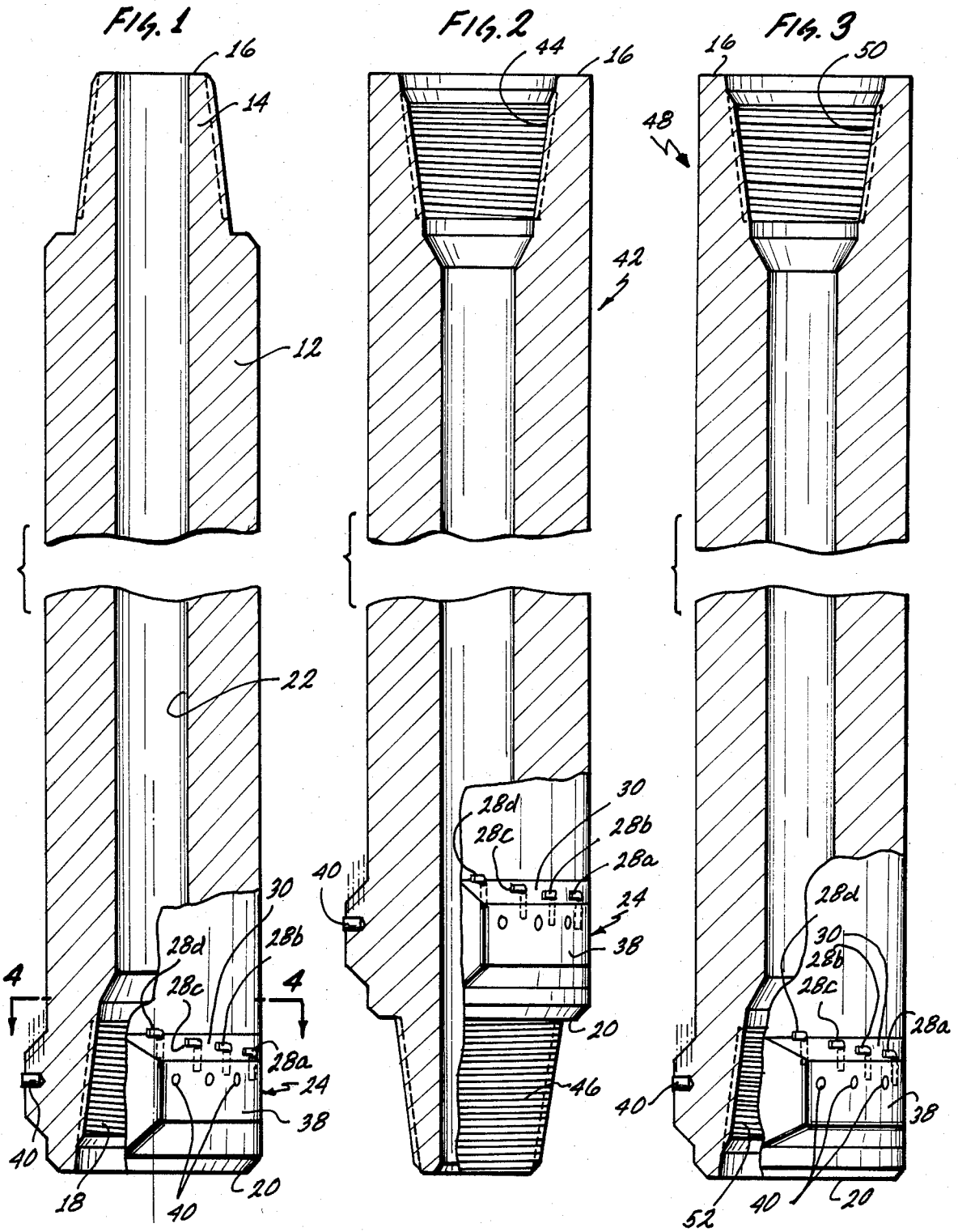
FIG. 1 is a partial elevational and cross-sectional view of an up-drill sub taken through line 1—1 of FIG. 4.
FIG. 2 is a partial elevational and cross-sectional view of a second embodiment of the up-drill sub.
FIG. 3 is a partial elevational and cross-sectional view of the third embodiment of the up-drill sub.
Figure 4:
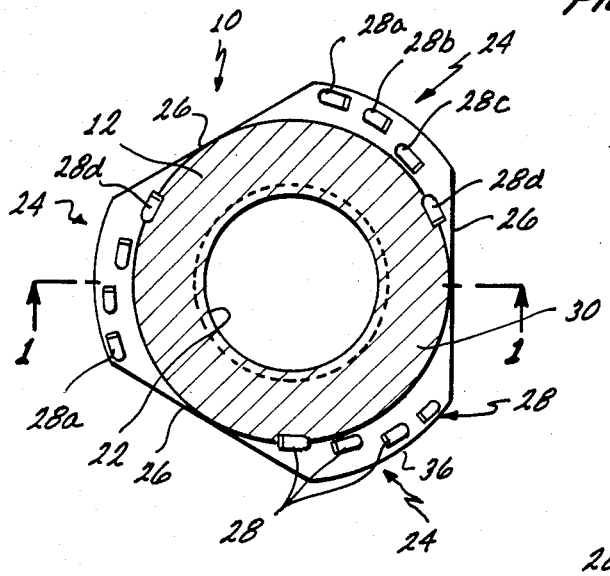
FIG. 4 is a plan elevational view of the first embodiment shown in FIG. 1, taken through line 4—4 of FIG. 1.

Consider now an up-drill sub 10 as illustrated in cross-sectional view shown in FIG. 1 taken through line 1—1 of FIG. 4. Sub 10 is characterized by a cylindrical body 12 which, as shown in the first embodiment of FIG. 1, includes a conventional threaded pin connection 14 formed at a first end 16 and a conventional threaded box connection 18 disposed within a second end 20 of sub 10. Cylindrical body 12 is a substantially straight subsection including an axial bore 22 communicating with a corresponding axial bore in the drill string through which hydraulic fluid is pumped, ultimately to the drilling bit. Body 12 is of sufficient length to allow conventional retrieval tools to attach thereto in the event that the sub must be fished from the bore for any reason.

In the first embodiment of FIG. 1, sub 10 is provided with connectors particularly adapted for direct coupling through box connector 18 to a mating pin connector on a drill bit while pin connector 14 is adapted for connection to a drill collar. Thus, the first embodiment of FIG. 1 can be positioned within the drill string immediately above the drilling bit as a near bit to provide "up-drill protection" for the bit in the manner described in greater detail below.

Sub 10 is particularly characterized by a plurality of chamfered lobes, generally denoted by reference numeral 24, disposed near end 20 of sub 10 and extending outwardly in a radial direction. Lobes 24 are better illustrated in a plan elevational view shown in FIG. 4 taken through line 4—4 of FIG. 1. In the first embodiment, three such lobes are equidistantly positioned about the circumference of sub 10. Lobes 24 are defined by three corresponding flat surfaces 26 which provide additional clearance for hydraulic fluid and other debris to flow upwardly between the drill pipe, sub 10 and the bore. In effect, surfaces 26 serve essentially the same function as junk slots in rotating bits.

Each lobe 24 is provided with a plurality of cutting elements **28*a–d* disposed on the upward chamfered surface 30 of lobe 24. Surface 30 is approximately sloped at 45 degrees with respect to the axis of rotation of the sub. Clearly other angles of slope could be used as well. For the purposes of the specification, the up direction shall be considered as toward end 16 of sub 10 and as generally in the same direction as defined by gravity within the bore when sub 10 is placed within the drill string as designed Cutting elements 28 are disposed upon chamfer surface 30 in a vertically and radially staggered array configured and adapted to cut in the upward direction as the drill string and sub 10**, which is connected to the drill string, is rotated in the conventional direction, that is in the direction normally assumed for downward drilling.

Figure 6:
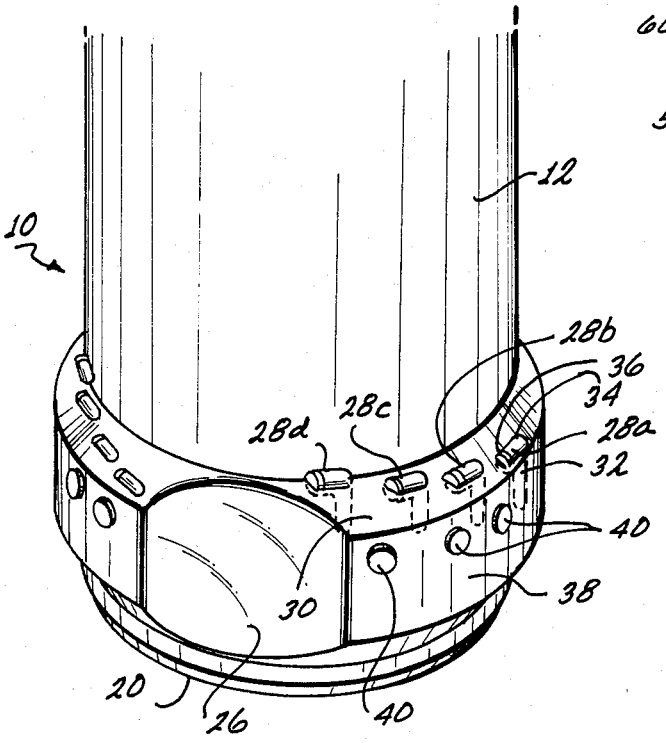
FIG. 6 is a pictorial perspective view of the tool of FIGS. 1 and 4.

Consider first the radial staggering as best shown in FIG. 4. In the illustrated embodiment, four cutting elements **28*a*–28*d* are provided on each lobe 24. Cutting elements 28*a*–28*d* are in the present embodiment polycrystalline diamond cutters mounted on tungsten carbide slugs brazed into mating holes machined into the body of lobes 24. Such cutting elements are well known and are sold by General Electric Company under the trademark. As better shown in the pictorial perspective view of FIG. 6, cutting elements 28*a*–28*d* include a vertical stud 32 which is formed into a horizontal arm 34 at one end of stud 32, upon which arm 34 a polycrystalline diamond table 36 is disposed. Arm 34 of cutters 28*a*–28*d* is oriented as best seen in plan view in FIG. 4 to present diamond table 36 in the forward direction, which in the illustration of FIG. 4 would be the leading face when sub 10 is rotated in a clockwise sense. The next adjacent cutting element 28*b* is radially disposed from the longitudinal axis of sub 10 by a predetermined amount less than the radial disposition of element 28*a*. Similarly, subsequent elements 28*c* and 28*d* are each radially set closer to the longitudinal axis of sub 10 than the preceeding element included in the corresponding series of cutting elements 28*a*–28*d* disposed on each lobe 24**.

As better illustrated in side elevational view shown in partial elevation near end 20 of sub 10 in FIG. 1, cutting elements **28*a*–28*d* are also staggered with respect to each other in the vertical direction, parallel to the longitudinal axis of sub 10. More specifically, the first cutting element 28*a* is the lowermost cutting element on surface 30. The next adjacent cutting element 28*b* is vertically displaced upward on surface 30 from the prior cutting element 28*a*. Thus, elements 28*a*–28*d* provide a series of vertically staggered elements beginning at the lowermost location of surface 30 and ending at and into the intersection of the uppermost portion of surface 30 and the outer cylindrical surface of body 12 of sub 10. In other words, uppermost element 28*d* is actually partially embedded into the cylindrical sidewall of body 12**.

The placement of uppermost element **28*d* is better illustrated in the plan elevational view of FIG. 4. In the illustrated embodiment, upper element 28*d* is shown as almost half embedded within body 12. This disposition of elements of 28*d* will thereby prevent the possibility of any bore casing, pipe or other object which may be flushly disposed against body 12 from being jammed between cylindrical body 12 and the uppermost cutting element. Element 28***d* will thus serve to cut into any flushly disposed object, thereby freeing the pipe seizure which initially or potentially caused the bore jam. Each of the remaining cutters 28*c*–28*a* are each overlapping so as to provided full azimuthal sweep of cutting elements as sub 10 rotates, thereby further preventing the possibility of jamming between any of the cutters. The staggered vertical placement of cutting elements 28*a*–28*d* as described in connection with FIG. 1 and as also pictorially shown in FIG. 6 similarly provides a complete vertical sweep across chamfered surface 30 as sub 10 rotates.

The cutters are substantially exposed above surface 30 to provide a maximum bite into the bore restriction. Turning now to FIG. 1, lobes 24 are also characterized by a substantially vertical, cylindrical surface 38 which serves as the gage of the sub 10. Circumferential surface 38 is also provided with a plurality of gage inserts 40, which in the illustrated embodiment are hardened tungsten carbide buttons flushly insert into surface 38 to provide conventional gage protection. Gage inserts 40 are disposed on a circumferential line and azimuthally distributed on surface 38 halfway between each of the cutters 28*a*–28*d* disposed in chamfered surface 30 above. Again, in the illustrated embodiment, the radially outermost extending portion of sub 10 is lobes 24 and in particular surfaces 38. The outer diameter of sub 10 as defined by gage surface 38 is smaller than that of the bore for which sub 10 is designed. Typically, the outer diameter of sub 10 is 3.2 mm ($\frac{1}{8}$ inch) less than the bore diameter. Therefore, during normal operations and tripping, the contact between sub 10 and the sides of the bore will be a free sliding contact as long as the bore has maintained its diameter and curvature. However, where a constriction of some type has arisen in the bore which is greater than the predetermined clearance between the bore diameter and the outer diameter of lobes 24, surface 30 and cutters 28*a*–28*d* will contact and cut the restriction.

Turning now to FIG. 2, a partial elevational and cross-sectional view of a second embodiment of a sub, generally denoted by reference numeral 42, is illustrated wherein like elements are referenced with like numerals relative to the first embodiment of FIG. 1. The second embodiment of FIG. 2 differs only from the first embodiment of FIG. 1 by the connections provided at the end of sub 42. Sub 42 is provided at end 16 with a conventional threaded box connection 44 and at opposing end 20 by conventional pin connection 46. Thus, sub 42 is configured and adapted for use within the drill string, such as between drill pipe and may be used in conjunction with stabilizers or other down-hole tool elements or positions which potentially represent locations of jamming or seizure with an imperfect bore.

Similarly, a third embodiment of the present invention is illustrated in partial elevational cross-sectional view in FIG. 3 which shows a sub, generally denoted by a reference numeral 48, wherein like elements have again been referenced by like numerals in comparison with the embodiment of FIG. 1. Sub 48 is substantially identical to the first and second embodiments of FIGS. 1 and 2 respectively, except the third embodiment of FIG. 3 is again provided with a differing combination of end connections. For example, upper end 16 is provided with conventional threaded box connection 50 whereas opposing end 20 is similarly provided with a conventional threaded box connection 52. The embodiments of FIGS. 1–3 clearly illustrate that the up-drill sub of the present invention may be configured in a variety of ways which allows the sub to be used in a large number of variations within a drill string and in combination with other drilling elements or bits. In each case, appropriate connections can be designed into the sub without altering or effecting the cutting efficiency or up-drill performance of the sub.

Figure 5:
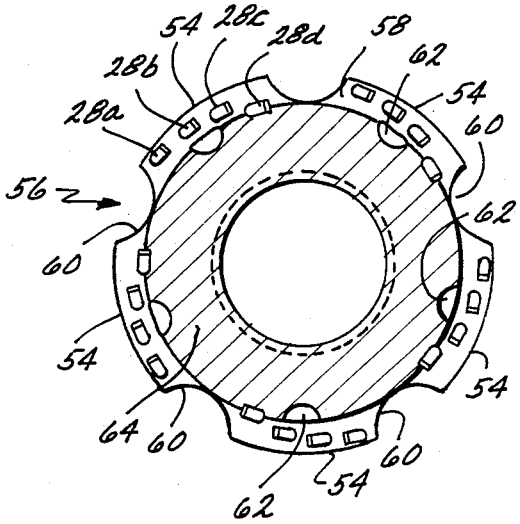
FIG. 5 is a plan elevational view of a fourth embodiment of the present invention taken through a section line similar to that shown in connection with FIG. 4.

Turning now to FIG. 5, a fourth embodiment of the present invention is illustrated in plan elevational view similar to that through which the view of FIG. 4 is depicted. In the embodiment of FIG. 5, five identical lobes 54 are provided about the circumference of the sub, generally denoted by reference numeral 56. Again, each lobe 54 is provided with a series of cutting elements 28*a*–28*d* as described above disposed upon similar chamfered upper surfaces 58 of lobes 54 as described in connection with the embodiment of FIGS. 1, 4 and 6. Each of the lobes 54 are defined and separated by an arcuate channel or junk slot 60 which serves essentially the same function of flat surfaces 26 of the embodiment of FIG. 4. In addition thereto, broach marks 62 are provided in cylindrical body 64 of sub 56 and extend longitudinally along the surface of cylindrical body 64 above and approximately along the longitudinal bisector of each lobe 54. Broach marks 62 are provided to provide additional clearance for the longitudinal flow of hydraulic fluid between the bore and sub and to compensate, at least in part, for the somewhat more restricted junk slot area provided by channels 60 as compared to larger flat surfaces 26 of the embodiment of FIG. 4.

Consider now the method of operation of a sub devised according to the present invention. When tripping the bit, if a tight spot is encountered, the drill string is immediately knocked back down free within the bore. The kelly is picked up and normal hydraulic drilling circulation is established. The string is picked back up to just below the tight spot, the slips are set and the pipe is rotated until it rotates free. After the drill string is once again rotating freely, rotation is stopped and the slips and low-drum clutch are manipulated to slightly pick up the drill string. Rotation is again commenced until the string is freely rotating. The process is repeated until the tight spot is completely drilled through. This operating procedure can be used on the up-drill sub of the present invention whether the sub is used as a near bit just above the drill bit, or is used elsewhere in the drill string, e.g. above a stabilizer, or as a crossover sub between the drill collar and drill pipe, that is to say at the highest point of the maximum diameter element within the string. It has been found that the present invention is highly effective in clearing the drill string from the bore when jammed by swelling salt, thick filter-cake built up by high porosity thief zones, or keyseats.

It must be understood that many modifications and alterations may be made by those having ordinary skill in the art without deparing from the spirit and scope of the present invention. For example, although tool embodiments have been shown wherein each lobe is provided with four STRATOPAX cutters, clearly other numbers or types of cutters could be employed or disposed on the lobes to provide a reamer devised according to the present invention. Similarly, tungsten-carbide gage buttons 40 have been shown in the illustrated embodiment. However, it must be clearly understood that polycrystalline diamond or natural diamond kickers could also be set within the gage to provide additional gage protection or to provide more aggressive reaming action on the gage. Further, the chamfer surface 30 has been shown in the illustrated embodiment as a 45 degree surface. Other slopes could similarly have been illustrated or compound sloped surfaces could have been employed to provide a stepped reaming collar without departing from the intent of the invention. Therefore, the illustrated embodiment must be read only for the purposes of clarification or example and should not be taken as limiting or defining the invention as set forth in the following claims.

I claim:

1. A tool for earth boring for use in a drill string, adapted to drill upwardly in a bore comprising:

a body;

a multiple lobed circumferentially disposed collar radially extending from said body and including an upwardly inclined surface on said collar; and a plurality of cutting elements disposed on said upwardly inclined surface on said collar arranged and configured to cut said bore as said tool is rotated and drawn upwardly within said bore, wherein said plurality of cutting elements includes at least one cutting element on each lobe of said multiple lobed circumferential collar wherein said at least one element is disposed into said body and into said collar to overlap the intersection therebetween.

2. The tool of claim 1 wherein said plurality of cutting elements is disposed in said inclined surface to provide overlapping disposition of said cutting elements as seen in an azimuthal swath as said tool is rotated.

3. The tool of claim 2 wherein said plurality of cutting elements are vertically overlapped across the entire longitudinal length of said collar.

4. The tool of claim 2 wherein said plurality elements are radially overlapping across the entire radial width of said collar.

5. The tool of claim 2 wherein said plurality of cutting elements disposed on said sloping surface are vertically and radially overlapping across the entire longitudinal length and radial width of said collar respectively.

6. A tool for earth boring for use in a drill string, said tool adapted to drill upwardly in a bore, said tool comprising:

a generally cylindrical body;

a plurality of lobes each with a gage surface, each lobe integrally formed with and radially extending from said body circumferentially disposed in a plane, each said lobe being characterized by an upper inclined surface and a generally cylindrical radial surface defining the outer diameter of said tool; and a plurality of cutting elements disposed on each said lobe and in particular on said upper inclined surface of said lobe, said cutting elements arranged and configured to cut said bore when said body is rotated and pulled upward in said bore, said plurality of cutting elements being radially and vertically staggered on said upper inclined surface in an overlapping relationship whereby said plurality of cutting elements on each said lobe provides complete coverage across said inclined surface as seen in an azimuthal swath cut by said plurality of elements on each lobe as said body rotates, wherein said plurality of cutting elements disposed on each lobe include polycrystalline diamond cutters; and wherein at least one cutting element on each lobe is disposed at least in part into said body and partly above said inclined surface and where the remaining cutting elements on said inclined surface are substantially exposed above said inclined surface.

7. The tool of claim 6 wherein said gage surface of each of said lobes is the outermost extending portion of said tool, thereby defining the outer diameter of said tool, and wherein said outer diameter of said tool is less than the diameter of said bore by a predetermined amount.

* * * * *